US008845283B2

(12) United States Patent
Cairo et al.

(10) Patent No.: US 8,845,283 B2
(45) Date of Patent: Sep. 30, 2014

(54) COMPRESSOR BLADE WITH FLEXIBLE TIP ELEMENTS AND PROCESS THEREFOR

(75) Inventors: Ronald Ralph Cairo, Greer, SC (US); Warren Arthur Nelson, Clifton Park, NY (US)

(73) Assignee: General Electric Company, Schenectady, NY (US)

( * ) Notice: Subject to any disclaimer, the term of this patent is extended or adjusted under 35 U.S.C. 154(b) by 379 days.

(21) Appl. No.: 12/955,009

(22) Filed: Nov. 29, 2010

(65) Prior Publication Data

US 2012/0134786 A1 May 31, 2012

(51) Int. Cl.

| | |
|---|---|
| ***F04D 29/08*** | (2006.01) |
| ***F04D 29/32*** | (2006.01) |
| ***F04D 29/16*** | (2006.01) |
| ***F04D 29/02*** | (2006.01) |

(52) U.S. Cl.

CPC ..... *F04D 29/164* (2013.01); *F04D 29/324* (2013.01); *F04D 29/023* (2013.01)

USPC ..... 415/173.3

(58) Field of Classification Search

CPC .... F04D 29/164; F04D 29/324; F04D 29/023

USPC ..... 415/173.3, 174.2

See application file for complete search history.

(56) References Cited

U.S. PATENT DOCUMENTS

| | | | | |
|---|---|---|---|---|
| 3,799,701 | A * | 3/1974 | Rothman | 416/226 |
| 5,181,728 | A * | 1/1993 | Stec | 277/355 |
| 5,683,789 | A | 11/1997 | Langenbrunner et al. | |
| 5,704,759 | A | 1/1998 | Draskovich et al. | |
| 5,752,802 | A * | 5/1998 | Jones | 415/170.1 |
| 6,012,723 | A * | 1/2000 | Beeck | 277/355 |
| 6,036,437 | A * | 3/2000 | Wolfe et al. | 415/173.3 |
| 6,171,351 | B1 * | 1/2001 | Schroder et al. | 51/295 |
| 6,206,642 | B1 * | 3/2001 | Matheny et al. | 416/230 |
| 6,547,522 | B2 * | 4/2003 | Turnquist et al. | 415/173.3 |
| 6,969,231 | B2 * | 11/2005 | Ghasripoor et al. | 415/173.4 |
| 7,549,841 | B1 * | 6/2009 | Marussich | 415/173.3 |
| 7,780,419 | B1 * | 8/2010 | Matheny et al. | 416/221 |
| 8,075,254 | B2 * | 12/2011 | Morgan et al. | 415/170.1 |
| 2003/0107181 | A1 * | 6/2003 | Wieghardt | 277/415 |
| 2004/0126225 | A1 * | 7/2004 | Ghasripoor et al. | 415/173.3 |
| 2006/0249911 | A1 * | 11/2006 | Kowalczyk et al. | 277/355 |

(Continued)

OTHER PUBLICATIONS

G. Sutter, S. Philippon, F. Garcin, Dynamic analysis of the interaction between an abradable material and a titanium alloy, Mar. 20, 2006, Elsevier, Wear 261, 686-692.*

*Primary Examiner* — Edward Look

*Assistant Examiner* — Eldon Brockman

(74) *Attorney, Agent, or Firm* — Ernest G. Cusick; Gary M. Hartman; Domenica N.S. Hartman

(57) ABSTRACT

A compressor blade and process for inhibiting rub encounters between a blade tip of the blade and an interior surface of a case that surrounds the rotating hardware within a compressor section of a turbomachine. The compressor blade includes a cap that defines the blade tip at a radially outermost end of the blade, and a plurality of flexible elements extending from a surface of the cap that defines the blade tip. The flexible elements extend from the surface in a span-wise direction of the blade, and are operable to become rigid due to centrifugal stiffening at compressor operating speeds and, optionally, cut a groove the interior surface of the case.

19 Claims, 1 Drawing Sheet

(56) References Cited

U.S. PATENT DOCUMENTS

2007/0120327 A1* 5/2007 Justak ..... 277/355
2007/0245532 A1* 10/2007 Bracken et al. ..... 29/23.51
2008/0296846 A1* 12/2008 Daggett et al. ..... 277/355
2009/0269189 A1* 10/2009 Bottome ..... 415/173.3

* cited by examiner

COMPRESSOR BLADE WITH FLEXIBLE TIP ELEMENTS AND PROCESS THEREFOR

BACKGROUND OF THE INVENTION

The present invention generally relates to compressors for turbomachinery, such as gas turbine engines. More particularly, this invention relates to a compressor blade whose tip incorporates a flexible cutting element for reducing the risk of damage to the blade tip that can occur due to rub encounters with a case surrounding the compressor.

Gas turbine engines generally operate on the principle of compressing air within a compressor section of the engine, and then delivering the compressed air to the combustion section of the engine where fuel is added to the air and ignited. Afterwards, the resulting combustion mixture is delivered to the turbine section of the engine, where a portion of the energy generated by the combustion process is extracted by a turbine to drive the engine compressor.

The compressor includes rotating hardware in the form of one or more disks or rotors from which airfoils (blades) extend radially across the airflow path through the engine. The radially outer limit of the airflow path within the compressor section is defined by a case that surrounds the rotating hardware. The case serves to channel incoming air through the compressor to ensure that the bulk of the air entering the engine will be compressed by the compressor. However, a small portion of the air is able to bypass the compressor blades through a radial gap present between the blade tips and the case at the outer airflow path within the compressor section. Because the air compressed within the compressor section is used to feed the turbine section of the engine, engine efficiency can be increased by limiting the amount of air which is able to bypass the compressor blades through this gap. Accordingly, the rotating hardware and case of a compressor section are manufactured to close tolerances in order to minimize the gap.

Manufacturing tolerances, differing rates of thermal expansion and dynamic effects limit the extent to which this gap can be reduced. As an example, the inner diameter of the case is never truly round and concentric with the axis of rotation of the compressor. As a result, there are instances when airfoil-to-case clearances are breached and blade tips rub the case. Blade tip rub damage can vary in form and severity. Damage to the tip of a blade may be in the form of one or more cracks or burrs, which can propagate through local vibratory modes in the tip region of the blade. For example, FIG. 4 schematically represents a severe tip burr (stress concentrator) 14 resulting from plastic deformation at the tip 12 of a blade 10. If the tip burr 14 is severe enough, the resulting stress concentration can amplify vibratory stresses due to tip modal vibration and cause degradation in the high cycle fatigue (HCF) life of the blade 10. Localized frictional heating also occurs from a blade rub, and may result in the formation of a brittle heat-affected zone (HAZ) 16 at the blade tip 12.

Several approaches have been proposed to address the problems of blade tip damage and air leakage at the outer airflow path. One approach involves applying an abradable material to the inner diameter of the compressor case so that the abradable material will sacrificially abrade away when rubbed by the blade tips. Another approach is to incorporate a cutting edge ("squealer tip") at the blade tip. In each case, the blade tips cut a groove in the inner diameter of the case during initial engine operation, creating a more tortuous path between the case and blade tips at the outer airflow path. Though effective, both techniques are expensive to implement. As an example, a cutting edge of a blade tip is typically formed by a coating, which can be difficult to deposit to a sufficient thickness to survive severe rub encounters often seen in field hardware. On the other hand, deposition of an abradable coating on the inner diameter of a compressor case requires close quality control to produce a suitable composition, including particle/void ratio and distribution, that will exhibit a proper hardness capable of avoiding blade tip damage during rub events. Rub encounters with an abradable coating that is excessively hard will cause scratches or cracks at the blade tip, and continued operation of the engine can cause scratches to serve as initiation sites for subsequent cracks due to vibratory stresses. Conversely, an abradable coating that is too soft can be eroded away by the high velocity gas flow in the compressor section.

In view of the above, improved techniques for reducing blade tip damage and air leakage at the outer airflow path of a compressor are desired.

BRIEF DESCRIPTION OF THE INVENTION

The present invention provides a compressor blade suitable for use as a component of rotating hardware within a compressor section of a turbomachine, and a process for inhibiting rub encounters between a blade tip of the blade and an interior surface of a case that surrounds the rotating hardware.

According to a first aspect of the invention, the compressor blade includes a cap that defines a blade tip at a radially outermost end of the blade, and a plurality of flexible elements extending from a surface of the cap that defines the blade tip. The flexible elements extend from the surface in a span-wise direction of the blade and are operable to become rigid due to centrifugal stiffening at compressor operating speeds. The flexible elements are optionally operable to cut a groove in the interior surface of the case at compressor operating speeds, or may be formed of a lubricious non-cutting material.

Another aspect of the invention is a process that includes fabricating a compressor blade to have a first joint interface at a radially outermost end thereof, fabricating a cap to have a second joint interface that has a complementary shape to the first joint interface of the blade, and providing a plurality of flexible elements extending from a surface of the cap that is oppositely-disposed from the second joint interface of the cap. The cap is then joined to the blade so that the first and second joint interfaces form a metallurgical joint, the surface of the cap defines a blade tip of the blade, and the flexible elements extend from the blade in a span-wise direction of the blade. The flexible elements are optionally operable to cut a groove in the interior surface of a case that surrounds the blade and the other rotating hardware of the compressor section, or may be formed of a lubricious non-cutting material.

A technical effect of the invention is the ability of the flexible elements to eliminate or at least drastically reduce the risk of blade tip damage from rub encounters with a compressor case that surrounds the blade and the remainder of the compressor rotating hardware. For example, the flexible elements may be adapted to cut a groove in the interior surface of the case. As a result of being cut by the flexible elements, the groove is substantially coaxial with the axis of rotation of the rotating hardware, and is radially spaced from the blade tip of the blade. The groove may be further capable of reducing air leakage through the outer airflow path of the compressor by improving outer flowpath sealing between the blade tips and the interior surface of the case. Alternatively, the flexible elements may be limited to forming a seal with the interior surface of the case.

Other aspects and advantages of this invention will be better appreciated from the following detailed description.

DETAILED DESCRIPTION OF THE INVENTION

Figure 1:
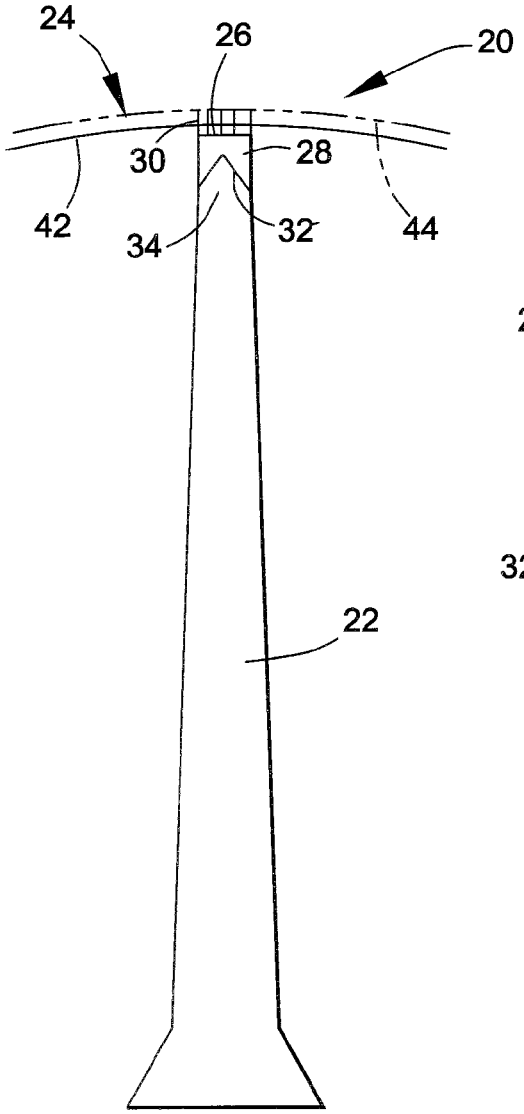
FIG. 1 represents a front view of a compressor blade having a blade tip configured in accordance with an embodiment of this invention, and an adjacent portion of a compressor case that surrounds the compressor rotating hardware of which the blade is a component.

FIG. 1 schematically represents a portion of a compressor section 20 of a turbomachine, for example, an industrial or aircraft gas turbine engine. A single compressor blade 22 of the compressor section 20 is shown, though it should be understood that the blade 22 is one of a number of blades 22. The blades and a disk (not shown) to which they are attached form part of the rotating hardware within the compressor section 20. As also shown in FIG. 1, the rotating hardware of the compressor section 20 is circumscribed by a case 24, a portion of which is represented in close proximity to the radially outermost tip 26 of the blade 22. The case 24 serves to channel the air flowing through the compressor so as to ensure that the bulk of the air entering the engine will be compressed within the compressor section 20. (In the orientation of FIG. 1, the direction of air flow would be directed into the plane of the page.) A small radial gap is present between the blade tip 26 and the case 24. Minimizing this gap promotes the efficiency of the compressor section 20 and the engine as a whole.

According to a preferred aspect of the invention, the blade 22 is provided with what will be referred to as a blade tip cap 28, which forms the outer radial extremity (tip 26) of the blade 22. The cap 28 incorporates cutting elements 30 intended to prevent or at least minimize rubbing between the blade tip 26 and the compressor case 24 that can lead to degradation of the HCF life of the blade 22. The cutting elements 30 can also serve to promote outer flowpath sealing with the case 24 by creating a more tortuous flow path between the blade tip 26 and the case 24.

Figure 2:
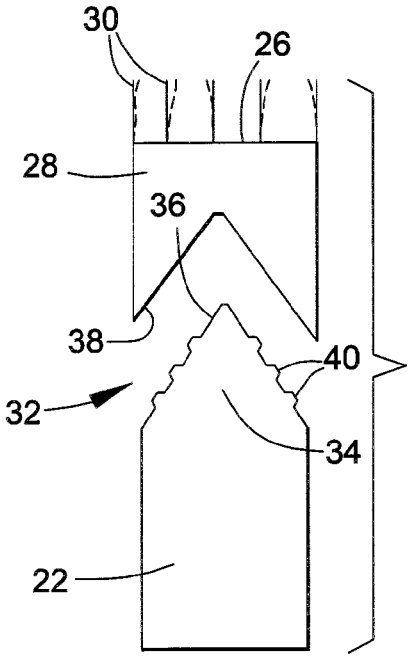
FIG. 2 is a detailed view of a blade tip cap and an adjacent portion of the blade of FIG. 1 prior to attaching the cap to the blade to form the blade tip of FIG. 1.

In FIGS. 1 and 2, the cutting elements 30 are represented as multiple wires or fibers that are spaced apart from each other in a chord-wise direction of the blade tip 26 and extend from the blade tip 26 in a direction essentially parallel to the span-wise axis of the blade 22. The elements 30 are adapted to cut the inner surface 42 of the case 24 surrounding the blade 22, yet are preferably lightweight so as contribute minimal parasitic loading to the blade 22. As represented in phantom in FIG. 2, the elements 30 are preferably flexible, but then become rigid at compressor operating speeds due to the physics of "centrifugal stiffening." The elements 30, when stiffened at compressor operating speeds, are able to act as cutting elements against the inner surface 42 of the case 24, and in doing so cut a groove 44 in the case inner surface 42 that is more nearly coaxial with the axis of rotation of the rotating hardware of the compressor than the inner surface 42. In effect, the elements 30 serve to bring the inner surface 42 of an otherwise out-of-round case 24 into concentricity with the axis of rotation of the compressor rotating hardware. As evident from FIG. 1, the groove 44 is radially spaced from the blade tip 26 of the blade 22, roughly corresponding to the lengths of the elements 30, such that the risk of blade tip damage from rub encounters with the case 24 is eliminated or at least drastically reduced. While FIGS. 1 and 2 depict the presence of five elements 30, a lesser or greater number of elements 30 could be employed. Generally speaking, it is believed that at least one hundred elements 30 per square inch (at least about fifteen elements 30 per square centimeter) should be present at the blade tip 26 in order to achieve an adequate cutting efficiency. The number of elements 30 is preferably limited so that adjacent elements 30 are spaced apart from each other at their respective points of attachment to the cap 28, so that the elements 30 retain their ability to flex. As an example, it may be necessary to limit the number of elements 30 to about six hundred elements 30 per square inch (about one hundred elements 30 per square centimeter).

The elements 30 can be formed of a variety of materials, notable examples of which include stainless steel wires, carbon steel wires, carbon fibers, aramid (for example, Kevlar®) fibers, alumina fibers, and silicon carbide fibers. To enhance their cutting capability, the elements 30 may be coated with an abrasive coating formed of, for example, cubic boron nitride, alumina, diamond, tungsten carbide or another hard abrasive material. Currently, alumina fibers and carbon fibers with a cubic boron nitride coating are believed to be preferred. Suitable processes for producing the elements 30 include such conventional methods as wire drawing for carbon steels and stainless steels, and spinning sol-gels or other chemical precursors to produce ceramic fibers. Abrasive coatings or particles can be applied by various techniques, for example, plating, brazing, or resin bonding. Suitable lengths and diameters for the elements 30 will depend in part on the particular application. However, the lengths and diameters of the elements 30 affect the flexibility and cutting capability of the elements 30, and therefore certain limits are believed to exist. For example, it is believed that the elements 30 should have lengths of at least 2.5 millimeters and may be as long as about 8.5 millimeters, with a preferred range being about 4 to about 6 millimeters. Furthermore, it is believed that the elements 30 should have diameters of at least 17 micrometers and may be as large as about 500 micrometers, with a preferred range being about 125 to about 300 micrometers.

Figure 3:
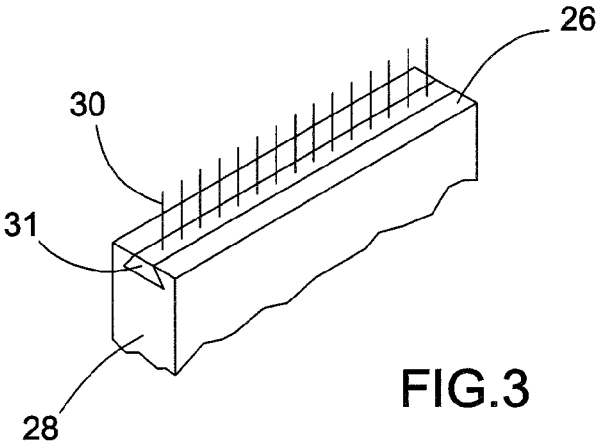
FIG. 3 is a detailed perspective view of the blade tip cap of FIG. 2, and represents a technique for retaining elements in the cap.

FIG. 2 shows the inner ends of the elements 30 as imbedded in the cap 28 and protruding through the blade tip 26 formed by the cap 28. FIG. 3 represents the cap 28 as having been fabricated to contain a surface cavity or slot in the surface that defines the blade tip 26, and the result of filling the slot with a material 31 that anchors the elements 30 to the cap 28. For example, the slot can be filled with a resin, braze alloy, or other material capable of securing and retaining the elements 30 under the operating conditions of the blade 10. Suitable processes for producing the cap 28 include such conventional methods as electro-discharge machining (EDM), grinding, milling, etc. The cap 28 is preferably formed of an alloy that is compatible with the alloy used to form the blade 22. In compressor blade applications for industrial gas turbine engines, notable examples of blade alloys include chromium-containing iron-based alloys such as GTD-450, AISI 403, and AISI 403+Cb. Chemical compatibility is particularly important in terms of the ability to metallurgical join the cap 28 to the blade 22 using such processes as brazing and welding, including welding techniques that use friction between the parts being welded to generate the welding temperatures. In view of these considerations, alloys that are believed to be particularly suitable for the cap 28 and subsequent joining to a blade formed of an iron-based alloy include GTD-450 and AISI 403+Cb. As noted above, suitable processes for joining the cap 28 and blade end 34 include brazing, welding and friction welding, with brazing currently viewed as the preferred method.

The cap 28 is further represented in FIGS. 1 and 2 as being fabricated to form a double scarf joint 32 with an end 34 of the blade 22 to which the cap 28 is attached. The double scarf joint 32 defines a joint interface 36 and 38 on each of the blade end 34 and cap 28, respectively. The joint interfaces 36 and 38 have shapes that are complementary to each other, and each joint interface 36 and 38 comprises a pair of faying surfaces that are inclined toward each other and neither parallel nor perpendicular to the span-wise axis of the blade 22. FIG. 2 further shows the joint interface 36 of the blade end 34 as incorporating perturbations 40 to promote metallurgical and mechanical interlocking at the joint 32, providing structural load path redundancy against the typically high centrifugal stress field existing within the blade 22 at compressor operating speeds. Alternatively or in addition, the joint interface 38 of the cap 28 may be formed to include perturbations, similar or complementary to the perturbations 40. Other known joint configurations are also possible, including forming one of the joint interface 36 and 38 as a dovetail and the other as a complementary dovetail slot.

Figure 4:
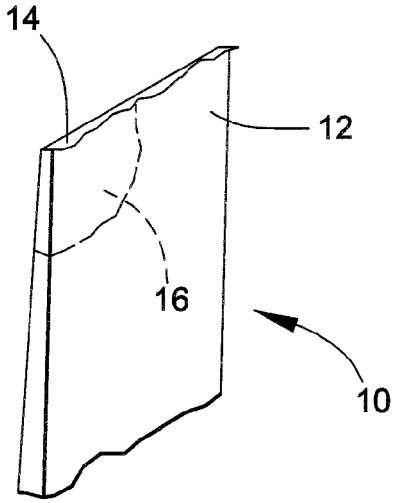
FIG.4 (Prior Art)
FIG. 4 represents a blade tip region of a prior art compressor blade and depicts several types of damage that can occur to the blade tip from rubbing encounters with a compressor case.

As a result of the elements 30 cutting the groove 44 in the inner surface 42 of the case 24, the likelihood that the blade tip 26 will be damaged by rub encounters with the case 24 are greatly reduced if not eliminated. As a result, typical forms of damage can be avoided or reduced, including the brittle HAZ 16 and minor and severe tip burrs 14 represented in FIG. 4, which can initiate cracks and, with subsequent propagation, can degrade the HCF life of the blade 22 and result in tip fracture driven by airfoil modal vibrations. The flexibility of the elements 30 is believed to be particularly advantageous, since their flexibility enables the elements 30 to be less prone to being completely removed when a severe rub encounter occurs, as often seen in turbomachines such as gas turbine engines. In addition, individual elements 30 are more likely to be lost as opposed to the majority of the elements 30, such that the cap 28 is able to continue providing a degree of cutting action against the case 24 that may be necessary as a result of subsequent rub encounters.

It is foreseeable that, in some situations, the ability of the elements 30 to cut a groove 44 in the inner surface 42 of the case 24 may be unnecessary. Accordingly, an alternative aspect of the invention is to form the flexible elements 30 to be lubricious and non-cutting, and therefore only flex on contact with the case 24. Lubricious non-cutting elements 30 are believed to be capable of reducing the risk of damage to the tip 26, as well as seal the radial clearance gap between the blade tip 26 and compressor case 24. In most cases, suitable lubricious materials for non-cutting elements 30 will be limited to the early stages of an industrial gas turbine compressor. Notable but nonlimiting examples of such materials include fiber materials such as carbon fibers or polymeric fibers, for example, Kevlar® fibers.

While the invention has been described in terms of a preferred embodiment, it is apparent that other forms could be adopted by one skilled in the art. For example, the physical configuration of the blade tip cap 28 and elements 30 could differ from that shown. It is also foreseeable that this invention could be used in combination with an abradable material incorporated into the region of the case 24 immediately circumscribing the tips of the compressor blades. Therefore, the scope of the invention is to be limited only by the following claims.

The invention claimed is:

1. A compressor blade configured to inhibit rub encounters between a blade tip thereof and an interior surface of a case that surrounds compressor rotating hardware that comprises the compressor blade, the compressor blade comprising:

a cap that defines the blade tip of the compressor blade at a radially outermost end of the compressor blade;

flexible elements extending from a surface of the cap that defines the blade tip and being supported solely by the cap, the flexible elements extending from the surface in a span-wise direction of the compressor blade, the flexible elements being operable to become rigid due to centrifugal stiffening at compressor operating speeds, the flexible elements comprising flexible cutting elements that exhibit an abrasiveness relative to the interior surface of the case so as to be operable to cut a groove in the interior surface of the case at compressor operating speeds, and the groove cut thereby is more nearly coaxial with an axis of rotation of the compressor rotating hardware than the interior surface so as to inhibit rub encounters between the blade tip and the interior surface of the case.

2. The compressor blade according to claim 1, wherein the flexible elements are spaced apart from each other on the surface of the cap in a chord-wise direction of the blade tip.

3. The compressor blade according to claim 1, wherein the flexible cutting elements have a minimum length of 2.5 millimeters and a maximum length of 8.5 millimeters and have a minimum diameter of 17 micrometers and a maximum diameter of 500 micrometers.

4. The compressor blade according to claim 1, wherein the flexible cutting elements are present on the surface of the cap in an amount of at least fifteen per square centimeter.

5. The compressor blade according to claim 1, wherein the flexible cutting elements are formed of a material chosen from the group consisting of stainless steel wires, carbon steel wires, carbon fibers, aramid fibers, alumina fibers, and silicon carbide fibers.

6. The compressor blade according to claim 5, wherein the flexible cutting elements comprise a coating of an abrasive material that promotes the abrasiveness of the flexible cutting elements relative to the interior surface of the case.

7. The compressor blade according to claim 1, wherein the flexible elements further comprise non-cutting flexible elements that are formed of a lubricious non-cutting material chosen from the group consisting of carbon fibers and polymeric fibers.

8. The compressor blade according to claim 1, wherein the cap is brazed or welded to the compressor blade at joint interfaces of the compressor blade and the cap.

9. The compressor blade according to claim 1, wherein the flexible elements are free to flex from the surface of the cap that defines the blade tip to oppositely disposed ends of the flexible elements.

10. The compressor blade according to claim 1, wherein the compressor blade is installed in a compressor section of a turbomachine as part of the compressor rotating hardware of the turbomachine, the interior surface of the case surrounds the compressor rotating hardware, and the flexible cutting elements have cut the groove in the interior surface of the case.

11. A turbomachine comprising the compressor blade of claim 1, the compressor blade being installed in a compressor section of the turbomachine as part of the compressor rotating hardware, the interior surface of the case surrounding the compressor rotating hardware, the case having in the interior surface thereof the groove cut by the flexible cutting elements.

12. The turbomachine according to claim 11, wherein the turbomachine is a gas turbine engine.

13. A process of inhibiting rub encounters between a compressor blade and an interior surface of a case that surrounds compressor rotating hardware that comprises the compressor blade, the process comprising:

fabricating the compressor blade to have a first joint interface at a radially outermost end thereof;

fabricating a cap to have a second joint interface that has a complementary shape to the first joint interface of the compressor blade;

providing flexible elements extending from a surface of the cap that is oppositely-disposed from the second joint interface of the cap, the flexible elements comprising flexible cutting elements that exhibit an abrasiveness relative to the interior surface of the case so as to be operable to cut a groove in the interior surface of the case;

joining the cap to the compressor blade so that the first and second joint interfaces form a metallurgical joint, the surface of the cap defines a blade tip of the compressor blade, and the flexible elements extend from the compressor blade in a span-wise direction of the compressor blade and are free to flex from the surface of the cap that defines the blade tip to oppositely disposed ends of the flexible elements;

installing the compressor blade in a compressor section of a turbomachine as part of the compressor rotating hardware and so that the case surrounds the compressor rotating hardware; and operating the turbomachine so that the flexible cutting elements become rigid due to centrifugal stiffening and cut the groove in the interior surface of the case surrounding the compressor rotating hardware, the groove in the interior surface being more nearly coaxial with an axis of rotation of the compressor rotating hardware than the interior surface so as to inhibit rub encounters between the blade tip and the interior surface of the case.

14. The process according to claim 13, wherein the flexible elements have a minimum length of 2.5 millimeters and a maximum length of 8.5 millimeters and a minimum diameter of 17 micrometers and a maximum diameter of 500 micrometers.

15. The process according to claim 13, wherein the flexible elements are present on the surface of the cap in an amount of at least fifteen per square centimeter.

16. The process according to claim 13, wherein the flexible cutting elements are formed of a material chosen from the group consisting of stainless steel wires, carbon steel wires, carbon fibers, aramid fibers, alumina fibers, and silicon carbide fibers.

17. The process according to claim 13, further comprising the step of depositing a coating of an abrasive material on surfaces of the flexible cutting elements to promote the abrasiveness of the flexible cutting elements relative to the interior surface of the case.

18. The process according to claim 13, wherein the flexible elements further comprise non-cutting flexible elements that are formed of a lubricious non-cutting material chosen from the group consisting of carbon fibers and polymeric fibers.

19. The process according to claim 13, wherein the turbomachine is a gas turbine engine.

* * * * *